United States Patent [19]

Hasebe et al.

[11] Patent Number: 4,753,202

[45] Date of Patent: Jun. 28, 1988

[54] IDLING SPEED CONTROL SYSTEM FOR INTERNAL COMBUSTION ENGINES

[75] Inventors: Hiroshi Hasebe, Hatogaya; Masahiko Asakura, Tokorozawa; Michio Sakaino, Fujimi; Yukio Miyashita, Hannou, all of Japan

[73] Assignee: Honda Giken Kogyo K.K., Tokyo, Japan

[21] Appl. No.: 880,782

[22] Filed: Jul. 1, 1986

[30] Foreign Application Priority Data

Jul. 5, 1985 [JP] Japan ..... 60-146605
Jul. 5, 1985 [JP] Japan ..... 60-146609
Jul. 5, 1985 [JP] Japan ..... 60-146604

[51] Int. Cl.[4] ..... F02D 41/16
[52] U.S. Cl. ..... 123/399; 123/360
[58] Field of Search ..... 123/339, 340, 350, 352, 123/360

[56] References Cited

U.S. PATENT DOCUMENTS 4,462,359 7/1984 Muller ..... 123/360
4,474,154 10/1984 Henning et al. ..... 123/339

FOREIGN PATENT DOCUMENTS 58-155255 9/1983 Japan .
59-155547 9/1984 Japan .
59-176443 10/1984 Japan ..... 123/339

*Primary Examiner*—Andrew M. Dolinar
*Attorney, Agent, or Firm*—Arthur L. Lessler

[57] ABSTRACT

An idling speed control system for controlling idling rotational speed of an internal combustion engine. A vacuum-operated actuator having a diaphragm defining a vacuum chamber controls opening and closing of a throttle valve in response to pressures suppliedfrom a change-over control valve to the vacuum chamber. The change-over control valve selectively supplies the vacuum chamber with a first control pressure for opening the throttle valve and a second control pressure for closing same. An electronic control unit generates an on-off control pulse signal having a pulse repetition period corresponding to rotational speed of the engine, one of on-period or off-period of the on-off control pulse signal having a predetermined constant value, and supplies the change-over control valve with the on-off control pulse signal. The electronic control unit is adapted to gradually increase the on-off pulse control signal when the engine rotational speed is in a first region higher than a predetermined idling rotational speed region, and gradually decrease the one of the on-period and off-period of the on-off control pulse signal when the rotational speed is in a second region lower than the predetermined idling rotational speed region.

5 Claims, 3 Drawing Sheets

IDLING SPEED CONTROL SYSTEM FOR INTERNAL COMBUSTION ENGINES

BACKGROUND OF THE INVENTION

This invention relates to an idling speed control system for internal combustion engines, and more particularly to a system of this kind which is capable of stabilizing the rotational speed of the engine at idle by controlling the quantity of intake air supplied to the engine.

An internal combustion engine for automotive vehicles is so constructed that the output power and rotational speed thereof are controlled by controlling the quantity of intake air by the use of a throttle valve. In an engine having a carburetor, a throttle valve is generally mounted in the carburetor and so arranged that the opening thereof can be adjusted by an idling opening adjusting bolt screwed in the body of the carburetor. The idling opening of the throttle valve is adjusted, by the use of the idling opening adjusting bolt, to a suitable value at the time of manufacture or maintenance operation of the engine, and therefore the idling opening thus set by the bolt cannot be arbitrarily further adjusted by a driver during operation of the engine.

Since the idling opening of the throttle valve thus has an adjusted fixed value, the rotational speed of the engine is kept constant, if the load on the engine does not vary during idling operation of the engine. However, if the load on the engine varies due to variations in the load on the generator for charging the battery or in the load on the automatic transmission, or due to switching-on and -off of the compressor in the air-conditioner, the rotational speed of the engine correspondingly varies, which makes it difficult to obtain stable idling speed and sometimes results in engine stalling. It is therefore necessary to set a desired idling speed at such a high value as to keep the engine always operating in a stable idling condition, without being influenced by the variations in the engine load. However, if the desired idling speed is set at such a high value, there can occur problems such as occurrence of large noise during idling operation of the engine, and increase of the fuel consumption.

To solve such problems, it has conventionally been proposed e.g. by Japanese Provisional Patent Publication No. 58-155255 to control the throttle valve opening during idling operation of the engine by the use of a pulse motor. Another method of controlling the idling speed of the engine has been proposed by Japanese Provisional Patent Publication No. 59-155547, which comprises detecting the rotational speed of the engine by the use of a predetermined crank angle signal, calculating the difference between the detected engine rotational speed and a desired idling speed, and controlling the quantity of intake air bypassing the throttle valve by controlling the duty ratio of a control valve with a control signal corresponding to the difference thus calculated, so as to attain the desired idling speed.

The above proposed methods, however, require complicated control systems as well as expensive control devices and control valves, and thereby are not practical.

SUMMARY OF THE INVENTION

It is an object of the invention to provide an idling speed control system which is simple in construction and can be manufactured at a low cost.

It is a further object of the invention to promptly bring the idling rotational speed of the engine to a predetermined desired value and thereby achieve stable idling operation of the engine.

According to the invention, the foregoing object is attained by providing an idling speed control system for controlling idling rotational speed of an internal combustion engine having an intake passage and a throttle valve arranged therein, comprising: vacuum-operated actuator means having a vacuum chamber, and a diaphragm defining the vacuum chamber and operatively connected to the throttle valve for controlling opening and closing thereof in response to pressure in the vacuum chamber; change-over control valve means operatively connected to the vacuum-operated actuator means for supplying the vacuum chamber, selectively, with a first control pressure for opening the throttle valve and a second control pressure for closing the throttle valve; and an electronic control unit operatively connected to the engine and the change-over control valve means, the electronic control unit being adapted to generate an on-off control pulse signal having a repetition period corresponding to rotational speed of the engine, and to supply the change-over control valve means with the on-off control pulse signal, in response to which the change-over control valve means supplies the vacuum chamber, selectively, with the first control pressure and the second control pressure.

The electronic control unit is adapted to gradually increase the on-off pulse control signal when the engine rotational speed is in a first region higher than a predetermined idling rotational speed region, and gradually decrease the one of the on-period and off-period of the on-off control pulse signal when the rotational speed is in a second region lower than the predetermined idling rotational speed region.

Preferably, the idling rotational speed region has a predetermined rpm range, and in which region the electronic control unit is adapted to hold the one of the on-period and off-period of the on-off control pulse signal at a fixed value.

For example, when the engine rotational speed enters the predetermined idling rotational speed region from either of the first and second regions, the electronic control unit holds the one of the on-period and off-period of the on-off control pulse signal at a value, as the fixed value, which is assumed immediately before the engine rotational speed enters the predetermined idling rotational speed region from the first or second region, and to which value the one of the on-period and off-period of the on-off control pulse signal has been increased if the engine rotational speed has been in the first region and decreased if it has been in the second region.

Preferably, the electronic control unit increases or decreases the one of the on-period and off-period of the on-off control pulse signal by a predetermined amount each time a predetermined period of time elapses, respectively, when the engine rotational speed is in the first or second region, the predetermined amount being increased as the engine is loaded with a larger load.

Also preferably, at least one of a predetermined upper limit and a predetermined lower limit is provided for the one of the on-period and off-period of the on-off control pulse signal.

DETAILED DESCRIPTION

The invention will now be described in detail with reference to the drawings showing an embodiment thereof.

Figure 1:
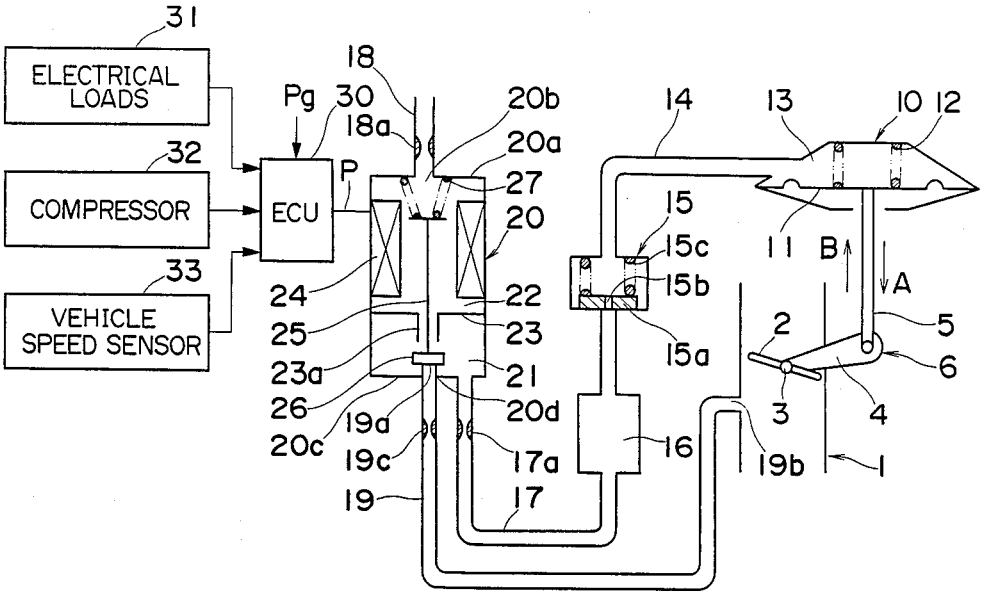
FIG. 1 is a schematic view illustrating the whole arrangement of an idling speed control system for internal combustion engines according to an embodiment of the invention.

Referring now to FIG. 1, there is illustrated the whole arrangement of an idling speed control system according to the invention. Reference numeral 1 designates an intake pipe, one end of which is connected to intake ports, not shown, of the engine, and the other end of which is connected to the atmosphere via an air cleaner, not shown. Arranged in the intake pipe 1 is a throttle valve 2 which is connected to a pneumatic actuator 10 by way of a link mechanism 6 comprising a lever 4 and a rod 5, and the opening of the throttle valve 2 is adjusted by the actuator 10 so that the engine rotational speed approaches a desired idling speed when the engine is operating in an idling condition.

The vacuum-operated actuator 10 is a push type which comprises a diaphragm 11, a vacuum chamber 13, and a coil spring 12. The vacuum chamber 13 communicates with a change-over control valve (hereinafter simply called "the solenoid valve") 20 comprising e.g. a frequency solenoid valve, through a passage 17. On the other hand, the diaphragm 11 is connected to the rod 5.

The solenoid valve 20 is an on-off type, of which a solenoid 24 is energized or deenergized in response to a control signal from an electronic control unit (hereinafter simply called "the ECU") 30. When the solenoid 24 is energized, a vacuum or negative pressure produced in the intake pipe 1 is introduced into the vacuum chamber 13 in the actuator 10, and when the solenoid 24 is deenergized, the atmospheric pressure is introduced into the vacuum chamber 13.

To be specific, the solenoid valve 20 has two chambers 21 and 22 separated by a partition wall 23 and communicating with each other through a communication port **23*a* provided centrally of the partition wall 23. The chamber 22 also communicates with the atmosphere by way of a passage 18 connected to a hole 20*d* formed in an end wall 20*a* of the chamber 22. One end 19*a* of a passage 19 is hermetically inserted into a hole 20*d* formed in an end wall 20*c* of the chamber 21 centrally thereof. The open end 19*a* of the passage 19 projects into the chamber 21 and is opposed to the communication port 23*a* in the partition wall 23 with a predetermined gap, and the other open end 19*b* communicates with the intake pipe 1 at a predetermined location downstream of the throttle valve 2**.

A plunger 25 axially movably extends through the solenoid 24 which is accommodated within the chamber 22 in the solenoid valve 20, with one end thereof slidably projected into the chamber 21 through the communication port **23*a*. A valve body 26 is secured to a face of the projected end of the plunger 25, and interposed between the communication port 23*a* and the open end 19*a* of the passage 19 such that it selectively closes the opposed open end of the communication port 23*a* or the open end 19*a* of the passage 19 in response to movement of the plunger 25. A return spring 27 is interposed in a contracted state between the other end of the plunger 25 and the opposed end wall 20*a* of the solenoid 20 such that it urges the plunger 25 in the direction in which the plunger projects into the chamber 21. The valve body 26 is urged against the open end 19*a* of the passage 19 by the return spring 27 when the solenoid 24 is deenergized, thereby closing the passage 19. The solenoid valve 24 has one connection terminal electrically connected to the ECU 30**, and the other connection terminal grounded.

Incidentally, the passages 17, 18, and 19 communicating with the solenoid valve 20 are provided therein respectively with restrictions **17*a*, 18*a*, and 19*c* at predetermined locations thereof for restricting fluctuations in pressure within respective passages which are to be introduced into the chambers 21, 22 of the solenoid 20**.

Further, a surging tank 16 for suppressing fluctuations in pressure within the passage 17 and a delay device 15 are arranged across the passage 17 between the vacuum-operated actuator 10 and the solenoid 20.

The delay device 15 is composed e.g. of a check valve having a valve body **15*a* formed with a restriction hole 15*b* and a spring 15*c* urging the valve body in the closing direction, and so arranged that when the negative pressure introduced into the vacuum chamber 13 is small relative to negative pressure within the chamber 21 of the solenoid valve 20, the valve body 15*a* is in contact with an end wall 15*d*, and when the former is large relative to the latter, the valve body 15*a* is detached from the end wall 15*d*, thereby changing the flow rate through the passage 17 between the valve opening speed and valve closing speed of the throttle valve 2**.

The ECU 30 is supplied with a load detection signal indicative of on-off states of electrical loads 31 such as headlights, which form a relatively small load applied on the engine, and another load detection signal indicative of on-off states of an electromagnetic clutch of a compressor 32 of an air-conditioner driven by the engine, which form a relatively large load applied on the engine.

Figure 2:
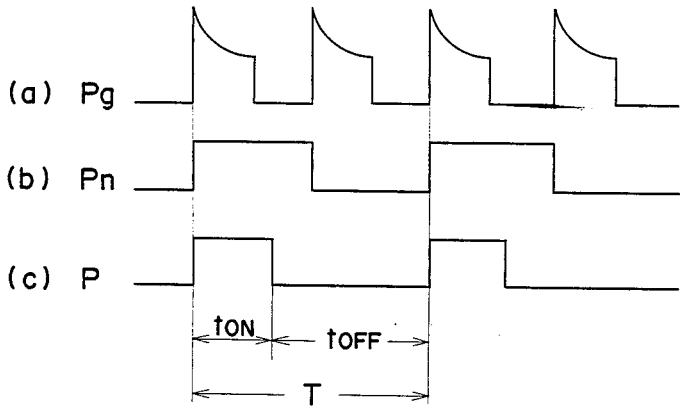
FIG. 2 is a graph showing waveforms of an on-off control pulse signal P generated from an electronic control unit appearing in FIG. 1 on the basis of the period of an ignition pulse signal Pg for on-off control of a solenoid valve of the idling speed control system, as well as corresponding processed pulses.

Further supplied to the ECU 30 are a signal generated in synchronism with the engine rotation, e.g. an ignition pulse signal Pg [(a) of FIG. 2] from the primary winding in the ignition coil, as well as a signal indicative of the vehicle speed V from a vehicle speed sensor 33.

Based on the ignition pulse signal Pg and the load detection signals inputted, the ECU 30 supplies the solenoid 24 of the solenoid valve 20 with an on-off control pulse signal P for on-off controlling the solenoid valve 20.

Reference is now made to the operation of the idling speed control system constructed as above.

When the solenoid 24 is deenergized by the control pulse signal P supplied from the ECU 30, the plunger 25 is biased toward the open end **19*a* by the urging force of the spring 27 so that the valve body 26 closes the open end 19***a* and opens the communication port 23*a*, whereby the atmosphere is introduced into the vacuum chamber 13 of the vacuum-operated actuator 10. Consequently, the diaphragm 11 of the actuator 10 is displaced in the direction of the arrow A in FIG. 1, by the urging force of the coil spring 12. On the other hand, when the solenoid 24 is energized by the control pulse signal P, the plunger 25 is attracted by a magnetic force produced by the solenoid 24 and overcoming the urging force of the spring 27, to close the communication port 23*a* and open the open end 19*a* of the passage 19, whereby negative pressure developed in the intake pipe 1 is introduced into the vacuum chamber 13. As a result, the diaphragm 11 of the vacuum-operated actuator 10 is displaced in the direction of the arrow B, that is, in the opposite direction to that in which the diaphragm 11 is displaced when the solenoid 24 is deenergized.

In this way, the opening of the throttle valve 2 is selectively controlled to a larger degree or to a smaller degree by controlling the duty ratio of the solenoid 24 of the solenoid valve 20 by the use of the control pulse signal P supplied from the ECU 30.

Reference is now made to how the control pulse signal P is generated from the ECU 30.

When the engine is not loaded, the ECU 30 is supplied with a signal generated in synchronism with the engine rotation, e.g. the ignition pulse signal Pg from the primary winding of the ignition coil [(a) of FIG. 2]. The ignition pulse signal Po has its frequency divided by a predetermined number N, e.g. two, to obtain a pulse signal Pn [(b) of FIG. 2]. Then, the ECU 30 generates a control pulse signal P [(c) of FIG. 2] which is at a high level for an on-state time period tON from the leading edge of each pulse of the pulse signal Pn.

The pulse repetition period T of the control pulse signal P is equal to that of the pulse signal Pn, wherein the solenoid 24 is energized for the on-state time period tON and then deenergized for an off-state time period +OFF (=T−tON).

The duty ratio of control pulse signal P supplied to the solenoid 24 of the solenoid valve 20, which determines the opening period ratio between the passage 19 and the communication port 23*a*, varies with the pulse repetition period T of the same signal P. The pulse repetition period T of the control pulse signal P in turn varies with the frequency of the ignition pulse Pg, which is a function of the engine rotational speed Ne. Therefore, the duty ratio of the solenoid valve 20 varies in response to the engine rotational speed Ne. To be specific, as described above, if the on-period or pulse duration tON of the control pulse signal P [(c) of FIG. 2] is fixed at a predetermined constant value, then the off-period tOFF becomes longer as the engine rotational speed Ne decreases, and vice versa.

Consequently, as the engine rotational speed Ne decreases, the opening period of the communication port 23*a* in the solenoid 20 which communicates with the atmosphere becomes longer, in response to which the negative pressure in the vacuum chamber 13 becomes smaller, so that the diaphragm 11 is displaced by the urging force of the spring 12 to move the rod 5 along the arrow A and thereby open the throttle valve 2. Then, the engine rotational speed Ne increases according to the longer opening action of the throttle valve 2. On the other hand, as the engine rotational speed Ne increases, the opening period of the communication port 23*a* in the solenoid valve 20 becomes shorter, and then the negative pressure PB in the intake pipe becomes higher. As a result, a high negative pressure is introduced into the vacuum chamber 13 of the vacuum-operated actuator 10 and accordingly the negative pressure therein becomes larger, so that the diaphragm 11 is attracted by the higher negative pressure in the vacuum chamber 13 against the urging force in the spring 12 to pull the rod 5 back along the arrow B and thereby close the throttle valve 2. Then, the engine rotational speed decreases according to the closing action of the throttle valve 2.

As described above, when the engine rotational speed Ne at engine idle is high, the ratio of the on-period (constant value) tON of the control pulse signal P to the period thereof becomes larger, the negative pressure for operating the diaphragm 11 becomes larger, and accordingly the opening of the throttle valve 2 is decreased. On the contrary, when the engine rotational speed Ne at engine idle is low, the ratio of the on-period tON of the control pulse signal P to the period thereof becomes smaller, the operating negative pressure becomes smaller, and accordingly the opening of the throttle valve 2 is increased.

Thus, according to the invention it is not necessary to calculate the duty ratio of the control pulse signal for on-off controlling the solenoid valve 20 nor necessary to provide expensive control devices such as a pulse motor. The control system according to the invention has a simple structure but is capable of achieving proportional feedback control of the idling speed in response to the engine rotational speed. Also, by changing the on-period tON of the control pulse signal P, in such manners as described later, an integral feedback control of the engine rotational speed is established which enables a feedback control of the idling rotational speed in response to the engine load.

The delay device 15 functions as follows:

When the negative pressure within the chamber 21 is smaller than that within the vacuum chamber 13 of the vacuum-operated actuator 10 due to an increase in the quantity of atmospheric air flowing into the chamber 21 of the solenoid valve 20, the valve body 15*a* of the delay valve 15 is acted upon by the differencial force between the negative pressure within the vacuum chamber 13 and that within the chamber 21 against the urging force of the spring 15*c*. Accordingly, atmospheric air is rapidly introduced into the vacuum chamber 13 so that the throttle valve 2 rapidly opens. On the contrarv, when the intake pipe negative pressure PB becomes higher so that the negative pressure within the chamber 21 exceeds that within the vacuum chamber 13, the valve body 15*a* is acted upon by the negative pressure within the chamber 21 in the direction of closing the valve body 15*a*. Accordingly, the atmospheric air is slowly introduced into the vacuum chamber 13 so that the throttle valve 2 slowly closes. In this wav, the opening speed of the throttle valve 2 is higher than the closing speed of same, and accordingly the increasing speed of the engine rotational speed Ne is higher than the decreasing speed of same, whereby the idling speed can be controlled in a stable manner.

Figure 3:
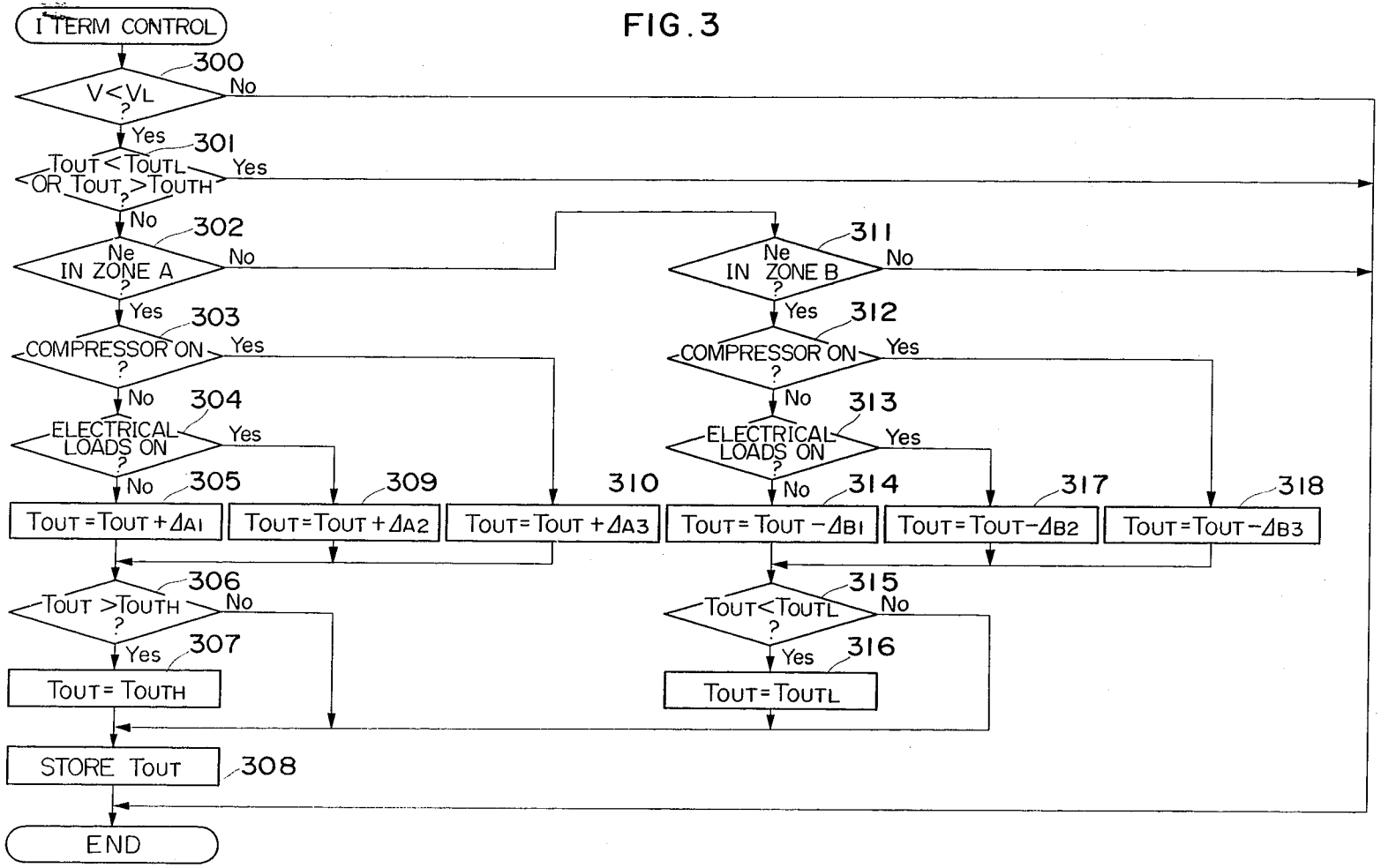
FIG. 3 is a flowchart showing a manner of integrally controlling an on-period tON of the on-off control pulse signal P.

FIG. 3 is a flowchart showing a manner of executing integral term control (hereinafter called "the I term control") of the on-period tON of the control pulse signal P (hereinafter called "the opening period TOUT" of the solenoid valve 20). The program for the I term control is executed at predetermined intervals (e.g. every 400 ms).

First, at step 300 it is determined whether or not the vehicle speed V sensed by the vehicle speed sensor 33 is lower than a predetermined value VL (e.g. 2 miles/h), and if the answer is No, it means that there is no need of controlling the idling speed since the vehicle is then running, and therefore the program is terminated without executing the I term control of the valve TOUT.

If the answer to the question of step 300 is Yes, the program proceeds to step 301 to determine whether or not the value TOUT is outside a range defined between a predetermined upper limit TOUTH and a predetermined lower limit TOUTL, and if the answer is Yes, it means that there is some existing abnormality somewhere in the system for detecting the ignition pulse signal Pg or in the system for processing the signal Pg and outputting the control pulse signal P, and then the program is terminated without executing the I term control of the value TOUT.

Figure 4:
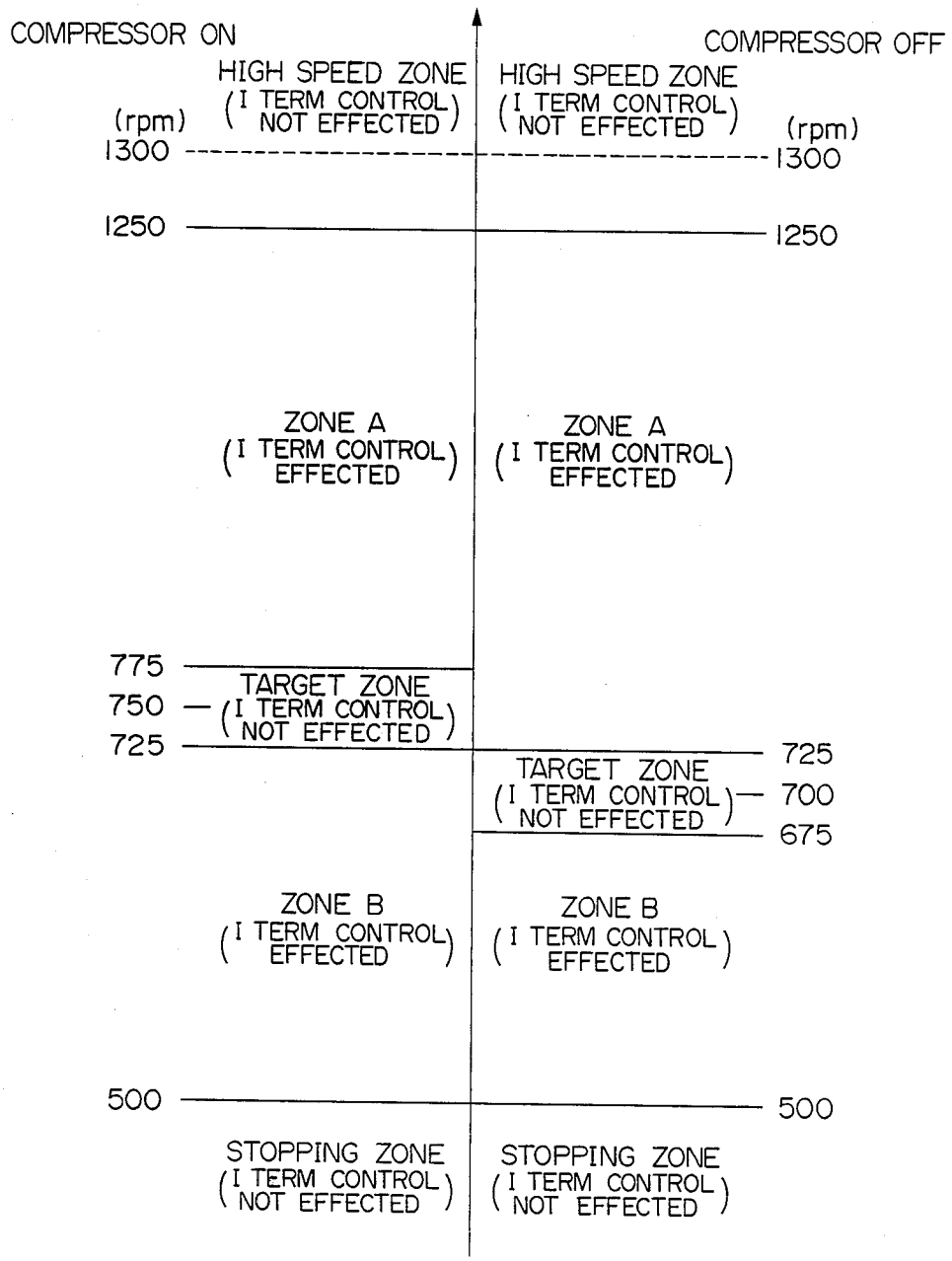
FIG. 4 is a view showing engine operating regions defined by values of the engine rotational speed, according to which the idling speed control is effected.

If the answer to the question at step 301 is No, the program proceeds to step 302. In the step 302 et seq., the I term control of the valve opening period TOUT is effected in a manner regulating the engine idling speed to a target zone (a predetermined idling rotational speed region) shown in FIG. 4. As shown in FIG. 4, this target zone is defined by different rpm values depending whether the compressor 32 of the air-conditioner installed in the vehicle is operating or not (on or off). When the compressor 32 is on, the target zone ranges from 725 to 775 rpm (i.e. 750+25), and when the compressor 32 is off the target zone ranges from 675 rpm to 725 rpm (i.e. 700+25 rpm).

At step 302 it is determined whether or not the engine rotational speed Ne is in a zone A which is a first operating region lying between the upper limit of the target zone and 1250 rpm (i.e. between 775 and 1250 rpm if the compressor is on, and between 725 and 1250 rpm if it is off). If the answer is Yes, the program proceeds to step 303. In the step 303 et seq., the I term control is effected in such a manner the opening period TOUT of the solenoid valve 20 is increased repeatedly at predetermined intervals. Incidentally, once the I term control is started upon determination of zone A, this control is not terminated even if the vehicle speed Ne exceeds the upper limit 1250 rpm as the throttle pedal (not shown) is depressed to thereby increase the opening of the throttle valve 2, so long as the vehicle speed does not exceed 1300 rpm. By virtue of this manner it is possible to prevent hunting which could occur as the throttle pedal is alternately depressed and released during the I term control.

At step 303 it is determined whether or not the compressor 32 of the air-conditioner is operated, and if the answer is No, the program proceeds to step 304 to determine whether or not any of the electrical loads 31 such as headlights is operating or on. If the answer to the question at step 304 is No, the program proceeds to step 305 to add a predetermined time period ΔA1 to the valve openining period TOUT. Then, at step 306, it is determined whether or not the newly obtained value of TOUT is greater than a predetermined upper limit TOUTH. If the answer is Yes, then at step 307 the value of TOUT is set to the predetermined upper limit TOUTH, which is then stored as the current value of TOUT at step 308, whereupon the program terminates. If the answer to the question at step 306 is No, then the program proceeds to step 308 to store the increased value of TOUT while skipping step 307. In this way, when the engine starts idling as a result of release of the throttle pedal, for instance, and the engine speed Ne enters zone A, then the valve opening period TOUT of the solenoid valve 20 is increased by dalta A1 each time the predetermined time period or 400 ms elapses, whereby the ratio of the TOUT value to the period T of the control pulse signal P is greater than that obtained by the proportional feedback control hereinbefore described. Therefore, the negative pressure in the vacuum chamber 13 is quickly increased to thereby cause the throttle valve 2 to be quickly closed. As a result, the engine rotational speed Ne is promptly regulated to the target zone.

If the answer to the question at step 303 is No, and at the same time if the answer to step 304 is Yes, that is, if the compressor 32 of the air-conditioner is off and any of the electric loads 31 is on, then a predetermined time period ΔA2, which is greater than the period ΔA1 used at step 305, is added to the opening period TOUT of the solenoid valve 20 (step 309). Then, at step 306, it is determined whether or not the newly obtained value of TOUT is greater than the predetermined upper limit TOUTH, and if the answer is Yes, then at step 307 the value of TOUT is set to TOUTH, which is then stored as the current value of TOUT at step 308, whereupon the program terminates. If the answer at step 306 is No, then the program goes to step 308 to store the increased TOUT value while skipping step 307. In this way, in the event that the engine load is increased as a result of an increase in the electrical load on the power generator for charging the vehicle battery due to turning-on of any of the electric loads 31 such as the headlights while if the engine speed Ne is in zone A, then the valve opening period TOUT of the solenoid valve 20 is increased by a predetermined time period ΔA2, which is greater than the time period ΔA1, each time the predetermined time period or 400 ms elapses. Therefore, even when the engine is burdened by increased electrical loads 31, the engine rotational speed Ne is promptly regulated to the target zone without delay.

If the answer to the question at step 303 is Yes, that is, if the compressor 32 of the air-conditioner is on, then regardless of whether any of the electrical loads 31 is on or off, a predetermined time period ΔA3, which is greater than the time period ΔA2, is added to the opening period TOUT (step 310). Then, at step 306, it is determined whether or not the newly obtained value of TOUT is greater than the predetermined upper limit TOUTH. If the answer is Yes, then at step 307 the value of TOUT is set to TOUTH, which is then stored as the current value of TOUT at step 308, whereupon the program terminates. In this way, in the event that the engine is loaded by the compressor 32 for compressing refrigerant as the air-conditioner is switched on while the engine speed Ne is in zone A, then the valve opening period TOUT of the solenoid valve 20 is increased by a predetermined time period ΔA3, which is greater than the time period ΔA2, each time the predetermined time period or 400 ms elapses. Therefore, even when the engine is heavily burdened by the compressor, the engine rotational speed Ne is promptly regulated to the target zone at a high speed.

If on the other hand, the answer to the question at step 302 is No, that is, if the engine rotational speed Ne is not in zone A, the program proceeds to step 311. At step 311 it is determined whether or not the engine rotational speed Ne is in a zone B which is a second operating region lying between the predetermined lower limit of the target zone and 500 rpm (i.e. between 500 and 725 rpm if the compressor is on, and between 500 and 675 rpm if it is off). If the answer is Yes, the program proceeds to step 312. In the step 312 et seq., the I term control is effected in such a manner that the opening period TOUT of the solenoid valve 20 is decreased.

At step 312 it is determined whether or not the compressor 32 of the air-conditioner is on. If the answer is No, the program proceeds to step 313 to determine whether or not any of the electric loads 31 such as the headlights is on. If the answer is negative, the valve opening period TOUT is decreased by a predetermined time period ΔB1 (step 314). Then, at step 315, it is determined whether or not the newly obtained value of TOUT is smaller than the predetermined lower limit TOUTL, and if the answer is Yes, then at step 316 the value of TOUT is set to TOUTL, which is then stored as the current value of TOUT at step 308, whereupon the program terminates. If the answer to the question at step 315 is No, then the program proceeds to step 308 to store the decreased TOUT value while skipping step 316. In this way, in the event that the engine starts idling as a result of release of the throttle pedal, for instance, and the engine speed Ne enters zone B, then the valve opening period TOUT of the solenoid valve 20 is decreased by dalta B1 each time the predetermined time period or 400 ms elapses, whereby the ratio of the TOUT value to the period T of the control pulse signal P is smaller value than that obtained by the proportional feedback control. Therefore, the negative pressure in the vacuum chamber 13 is quickly decreased to thereby cause the throttle valve 2 to be quickly opened. As a result, the engine rotational speed Ne is promptly regulated to the target zone, and hence engine stall is avoided.

If the answer to the question at step 312 is No, and at the same time if the answer to step 313 is Yes, that is, if the compressor 32 is off and any of the electric loads 31 is on, then a predetermined time period ΔB2, which is greater than the time period ΔB1, is subtracted from the opening period TOUT (step 317). Then, at step 315, it is determined whether or not the newly obtained value of TOUT is smaller than the predetermined lower limit TOUTL, and if the answer is Yes, then at step 316 the value of TOUT is set to TOUTL, which is then stored as the current value of TOUT at step 308, whereupon the program terminates. If the answer to the question at step 315 is No, then the program proceeds to step 308 to store the decreased TOUT value while skipping step 316, and the terminates. IN this way, in the event that the engine load is increased as a result of an increase in the electrical load on the power generator due to turning-on of any of the electrical loads 31 while the engine speed Ne is in zone B, then the valve opening period TOUT of the solenoid valve 20 is decreased by ΔB2, which is greater than ΔB1, each time the predetermined time period or 400 ms elapses. Therefore, even when the engine is burdened by any of the electrical loads 31, the engine rotational speed Ne is promptly regulated to the target zone without delay. Therefore, similarly to the preceding examples engine stall is avoided.

If the answer to the question at step 312 is Yes, that is, if the compressor 32 is on, then regardless of whether any of the electric loads 31 is on or off, a predetermined time period ΔB3, which is greater than the time period ΔB2, is subtracted from the opening period TOUT (step 318). Then, at step 315, it is determined whether or not the newly obtained value of TOUT is smaller than the predetermined lower limit TOUTL, and if the answer is Yes, then at step 316 the value of TOUT is set to TOUTL, which is then stored as the current value of TOUT at step 308, whereupon the program terminates. On the other hand, if the answer to the question at step 315 is No, the program jumps to step 308 to store the decreased TOUT value. In this way, in the event that the engine is loaded by the compressor 32 as the air-conditioner is switched on while the engine speed Ne is in zone B, then the valve opening period TOUT of the solenoid valve 20 is decreased by ΔB3, which is greater than ΔB2, each time the predetermined time period elapses. Therefore, even when the engine is heavily burdened by the compressor, the engine rotational speed Ne is promptly regulated to the target zone at a high speed. Therefore, similarly to the preceding examples engine stall is avoided.

As described above, it is possible according to the invention to promptly regulate the engine rotational speed to the predetermined target zone or idling rotational speed region to thereby improve stability of the idling rotational speed.

If the answer to the question at step 311 is No, the program immediately terminates without effecing the I term control of the opening period of TOUT of the solenoid valve 20. That is, as indicated in FIG. 4, the I term control is prohibited when the vehicle speed is in a zone other than the zones A and B. Since the target zone, where the I term control is prohibited, has a speed range of 50 rpm, there is no fear of hunting, i.e. the phenomenon that the I term control is repeatedly effected to alternately decrease the engine speed from zone A and increase the engine speed from zone B.

Further, as noted above, according to the invention, the valve openeing period TOUT of the solenoid valve is held at a value assumed immediately before the engine speed Ne enters the target zone from zone A, or at a value assumed immediately before the engine speed Ne enters the target zone from zone B, and the held TOUT value is employed as the fixed valve opening period as long as the engine speed Ne stays in the target zone. This TOUT value holding is effective to enhance the responsiveness of control of the valve opening period TOUT at the time the engine speed Ne again shifts to zone A or zone B from the target zone, that is, to increase the speed at which the engine speed returns from zone A or B.

When the engine speed Ne is in a zone less than 500 rpm where the engine is about to stop, the engine cannot maintain its stable operation and therefore there is no need of controlling the engine operation. Also, when the engine speed Ne is in a high speed zone higher than 1250 rpm, there is no need of idling rotational speed control, either. Hence, in these zones the I term control of the value TOUT is not effected.

Further, as stated above, according to the invention, by providing the predetermined upper limit TOUTH and lower limit TOUTL for the valve opening period TOUT of the on-off control pulse signal (step 301) it is possible to prohibit the I term control when some abnormality occurs in the system for detecting the ignition pulse signal Pg or in the system for processing the signal Pg and outputting the control pulse signal P, whereby the variable range of the valve opening of the throttle valve is prevented from being excessively large, which would result in large fluctuations in the idling speed. Further, since the initial value of the valve opening period TOUT of the control pulse signal to be assumed at the start of the I term control loop is limited between the predetermined upper and lower limits TOUTH, TOUTL (steps 307 and 316), the difference between the initial value and the target zone is kept so small as to shorten the time required to bring the initial value to the target zone.

Although the foregoing embodiment is directed to the I term control of the on-period tON of the on-off control pulse signal P, the off-period tOFF may be controlled in a similar manner, instead. In such alternative embodiment, the off-period tOFF may be set to vary as a function of the engine speed and/or used to increase the valve opening of the throttle valve, and the on-period tON may be used to decrease same, respectively, as contrary to the foregoing embodiment.

What is claimed is:

1. An idling speed control system for controlling idling rotational speed of an internal combustion engine havnig an intake passage and a throttle valve arranged therein, comprising:

vacuum-operated actuator means having a vacuum chamber, and a diaphragm defining siad vacuum chamber and operatively connected to said throttle valve for controlling opening and closing thereof in response to pressure in said vacuum chamber;

change-over control valve means operatively connected to said vacuum-operated actuator means for supplying said vacuum chamber selectively, with a first control pressure for opening said throttle valve and a second control pressure for closing said throttle valve; and an electronic control means operatively connected to said engine and said change-over control valve means, said electronic control means being adapted to generate an on-off control pulse signal having a repetition period corresonding to rotational speed of said engine, and to supply said change-over control valve means with said on-off control pulse signal, in response to which said change-over control valve means supplies said vacuum chamber, selectively, with said first control pressure and said second control pressure, said electonic control means being adapted to hold one of the on-period and off-period of said on-off control pulse signal at a constant predetermined period of time, when said engine rotational speed is in a predetermined idling rotational speed region, said one of said on-period and off-period causing supply of a predetermined one of sid first and second control pressures to said vacuum chamber and being also adapted to change said one of said one-period and off-period of said on-off control pulse signal in such a manner that said engine rotational speed decreases, each time a predetermined period of time elapses, when said engine rotational speed is in a first region higher than said predetermined idling rotational speed region, and to change said one of said on-period and off-period of said on-off control pulse signal in such a manner that said engine rotational speed increases, each time said predetermined period of time elapses, when said engine rotational speed is in a second region lower tnan said predetermined idling rotational speed region.

2. An idling speed control system as claimed in a claim 1, wherein said predetermined idling rotational speed region has a predetermined rpm range, and in said region said electronic control means is adapted to hold said one of said on-period and off-period of said on-off control pulse signal at a fixed value.

3. An idling speed control system and claimed in claim 2, wherein when said engine rotational speed enters said predetermined idling rotational speed region from either of said first and second regions, said electronic control means holds said one of said on-period and off-period of said on-off control pulse signal at a value, as said fixed value, which is assumed immediately before said engine rotational speed enters said predetermined idling rotational speed region from said first or second region, and to which value said one of said on-period and off-period of said on-off control pulse signal has been increased if said engine rotational speed has been in said first region and decreased if it has been in said second region.

4. An idling speed control system as claimed in claim 1, wherein at least one of a predetermined upper limit and a predetermined lower limit is provided for said one of said on-period and off-period of said on-off control pulse signal.

5. An idling speed control system for controlling idling rotational speed of an internal combustion engine having an intake passage and a throttle valve arranged therein comprising:

vacuum-operated actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure ror opening said throttle valve and a second control pressure for closing said throttle valve; and an electronic control means operatively connected to said engine and said change-over control valve means, said electronic control means being adapted to generate an on-off control pulse signal having a repetition period corresponding to rotational speed of said engine, and to supply said change-over control valve means with said on-off control pulse signal, in response to which said change-over control valve means supplies said vacuum chamber, selectively, with said first control pressure and said second control pressure, said electronic control means being adapted to gradually increase said on-off pulse control signal when said engine rotational speed is in a first region higher than a predetermined idling rotational speed region, and gradually decrease said one of said on-period and off-period of said on-off control pulse sigal when said engine rotational speed is in a second region lower than said predetermined idling rotational speed region, said electronic control means being adapted to increase or decrease said one of said on-period and off-period of said on-off control pulse signal by a predetermined amount each time a predetermined period of time elapses, respectively, when said engine rotational speed is in said first or second region, said predetermined amount being increased as said engine is loaded with a larger load.

* * * * *